United States Patent [19]

Holmes

[11] 4,215,892

[45] Aug. 5, 1980

[54] LATCHING MECHANISM FOR SPREADER

[75] Inventor: William K. Holmes, Rothschild, Wis.

[73] Assignee: J. I. Case Company, Racine, Wis.

[21] Appl. No.: 947,550

[22] Filed: Oct. 2, 1978

[51] Int. Cl.[2] ..... B66C 1/66

[52] U.S. Cl. ..... 294/815 F; 294/67 DA

[58] Field of Search ..... 294/815 F, 67 DA, 67 D, 294/67 DB, 81 R, 88, 110, 74; 414/620, 621, 730

[56] References Cited

U.S. PATENT DOCUMENTS

| | | | |
|---|---|---|---|
| 3,458,229 | 7/1969 | Nagy et al. | 294/815 F |
| 3,888,536 | 6/1975 | Durenec | 294/815 F |

*Primary Examiner*—James B. Marbert

*Attorney, Agent, or Firm*—Dressler, Goldsmith, Shore, Sutker & Milnamow, Ltd.

[57] ABSTRACT

A latching mechanism for attaching a spreader to corner castings of a container includes an elongated shank having locking lugs at one end thereof with a locator member surrounding the shank and mounting means for mounting the shank and locator member on the spreader frame. The mounting means is designed to accommodate universal movement of the shank about a fixed point on the frame and also accommodate axial movement of the shank with respect to the fixed point so that the spreader is capable of being utilized with different types of standard castings having apertures with different transverse spacings.

12 Claims, 5 Drawing Figures

LATCHING MECHANISM FOR SPREADER

BACKGROUND OF THE INVENTION

The present invention relates generally to spreader frames used for lifting containerized cargo and more specifically to an improved latching mechanism for attaching the spreader to the container.

In recent years, considerable attention has been directed to development of equipment that is capable of lifting and transporting cargo that is enclosed in containers. These containers have become fairly well standardized being 8 feet wide, 8 feet high and of varying length such as 20, 24, 30, 35 or 40 feet. In order to facilitate efficient handling of these containers of varying length, another international standardization has taken place in that the containers have corner castings at each of the corners provided with an aperture for receiving a locking device or latching mechanism that is mounted on the spreader frame.

The most widely used container has a standard corner casting which conforms to a standard developed by the International Organization for Standardization (ISO Standard) in which all of the castings have an identical size aperture therein and the transverse spacing between the two corner members at each end of the container have a nominal center to center spacing laterally of 89 inches (224.5 centimeters). Another well known type of standard container may have the same general dimensions as indicated above and the corner castings have apertures which are of a different size and configuration and this type of container is commonly known as the "Sealand" container (Sealand Standard). In addition to having a different configuration for the apertures for Sealand Standard, the adjacent corner castings also have the apertures spaced from each other by a center to center dimension of 90 inches (227 centimeters). Thus, the apertures in the corner castings for these two standards are not equidistantly spaced from each other and require a coupling mechanism having different dimensions.

In recent years numerous proposals have been made for the development of a universal latching mechanism which can be used with both the ISO Standard and the Sealand Standard containers. Examples of such latching mechanisms are disclosed in U.S. Pat. Nos. 3,368,838; 3,749,438; 3,751,096; 3,753,588; and 3,799,601. A further type of prior art latching mechanism that has previously been used for accommodating containers with different standard fittings consists of an enlarged ball on the end of the locator which surrounds the shank of the latching member with the enlarged ball being received into a spherical opening in the frame to accommodate universal movement of the free end of the shank with respect to the frame.

While numerous types of latching mechanisms have been proposed for accommodating containers with both ISO Standard and Sealand Standard, none of these mechanisms have received any remarkable degree of commercial acceptance for various reasons. So far as presently known, the only two types of commercial universal latching mechanisms for accommodating containers with ISO and Sealand castings are disclosed in U.S. Pat. Nos. 3,753,588 and 3,749,438. The latching systems disclosed in both of these patents operate on the same common principal of having the rotatable shank or locking member located on a fixed axis and the center to center spacing of the free ends of an adjacent pair of shanks on one end of a spreader is fixed. The variations in the size of the apertures for the two standards is accommodated by the configuration of the latching lugs and/or the size thereof. In both types of latching mechanisms, the surface contact between the casting and the bearing lugs is rather minimal which in some instance may result in having the latching members slip out of the aperture while the container is being lifted. Another problem encountered with the devices of this type is the fact that no provision is made for accommodating for any slight misalignment of the latching lugs with the apertures as the spreader is being aligned with the container. Thus, if the casting member is slightly defective or distorted on the container, it may be impossible for the operator to insert the fixed lugs and shanks into the respective apertures.

It has also been proposed to mount the free end of the latching mechanism for some limited movement such as disclosed in U.S. Pat. Nos. 3,751,096 and 3,677,599. However, these proposed solutions have not been accepted commercially and it is assumed the lack of acceptance can be contributed to the inability of these systems to withstand the abuse encountered during use.

SUMMARY OF THE INVENTION

According to the present invention, a spreader has four latching mechanisms on each of the four corners thereof and each latching mechanism is mounted on a fixed center to center spacing which is greater than the center to center spacing of the apertures for the ISO Standard container casting and less than the spacing for the Sealand Standard casting.

Each latching mechanism or twist-lock consists of an elongated shank that has locking lugs at one end thereof with a locator member surrounding the shank adjacent the locking lugs and mounting means on the frame for the shank. The mounting means accommodates universal movement of the shank about a fixed point on the frame and also accommodates axial movement of the shank with respect to the fixed point to allow the free end of the shank with the lugs thereon to be shifted sufficiently to enter the apertures of both the ISO Standard spacing and the Sealand Standard spacing and also to accommodate slightly defective or distorted castings having the apertures therein.

More specifically, the mounting means consists of a bearing member on the mounting frame that has a spherical circular inner surface and a reduced portion of the shank has a sleeve supported thereon in a circular opening with the sleeve having a spherical bearing member supported thereon and in engagement with the spherical opening in the bearing member to accommodate such universal movement about the center of the opening as well as axial movement of the shank with respect to the center thereof.

Each latching mechanism also has cooperating means with the frame and the locator to prevent rotational movement of the locator with respect to the frame and also to limit the amount of axial movement of the shank with respect to the frame. In the embodiment illustrated, the shank has an enlarged portion adjacent the locking lugs on the free end thereof and a reduced portion cooperating with the enlarged portion to define a shoulder intermediate opposite ends of the shank. The locator member surrounds a portion of both the enlarged portion and the reduced portion and has a shoulder that engages the shoulder on the shank to prevent axial movement of the locator member towards the lug end of the shank. The cooperating shoulders between the shank and the locator member will cause the locator member to move upwardly with the shank and engage the frame directly to absorb any shock loads that may be imparted to the shank. The cooperating means also includes a projection extending from the locator member into a recess in the frame which prevents rotational movement of the locator member with respect to the frame while accommodating rotational movement of the shank within the locator member.

The respective pairs of latching members on opposite ends of the spreader frame are simultaneously actuated by a single fluid ram having a single piston slidable therein and two piston rods extending therefrom in opposite directions.

With the arrangement described above, the size of the locator member as well as the latching lugs and shank can be made larger specifically as large as the smallest size aperture for the respective types of castings.

DETAILED DESCRIPTION

Figure 1:
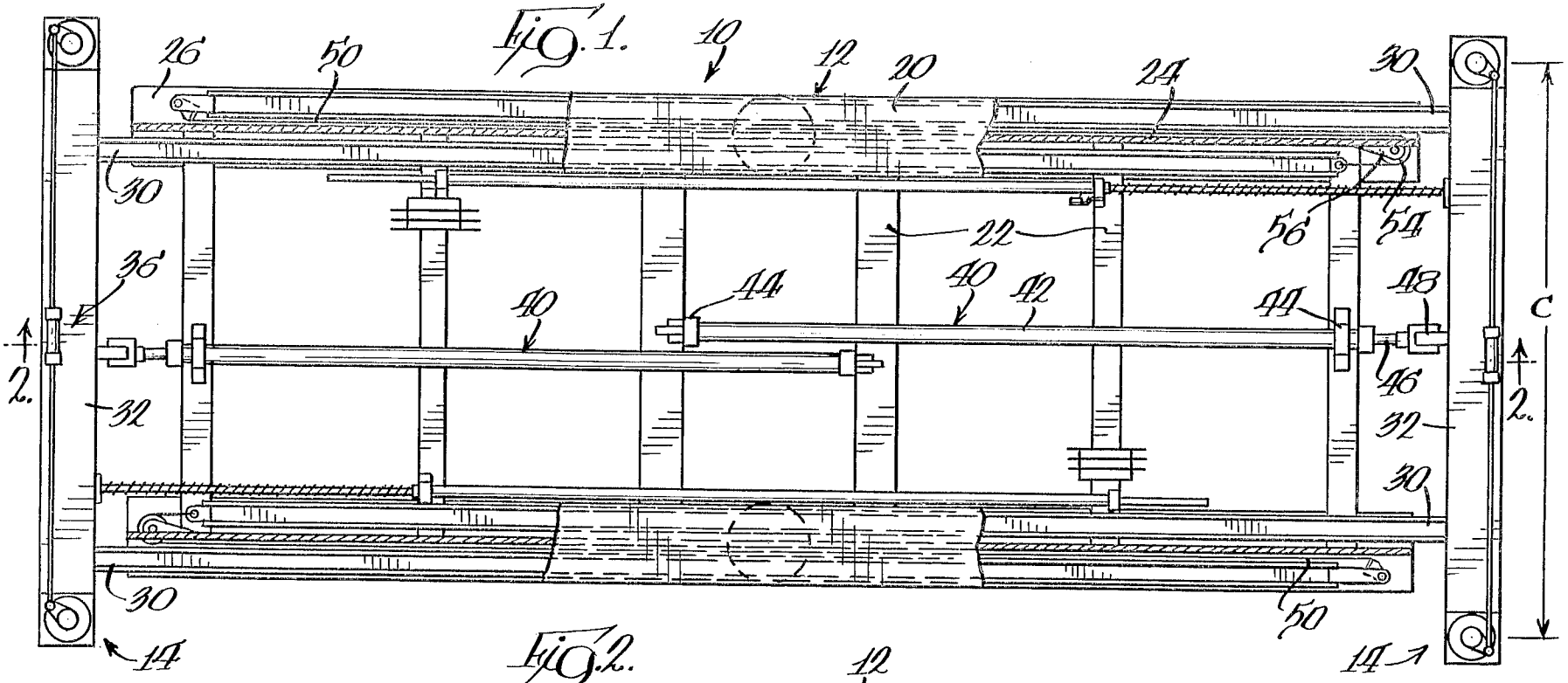
FIG. 1 shows a plan view of the spreader having the present invention incorporated therein with portions thereof broken away for clarity.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

Figure 2:
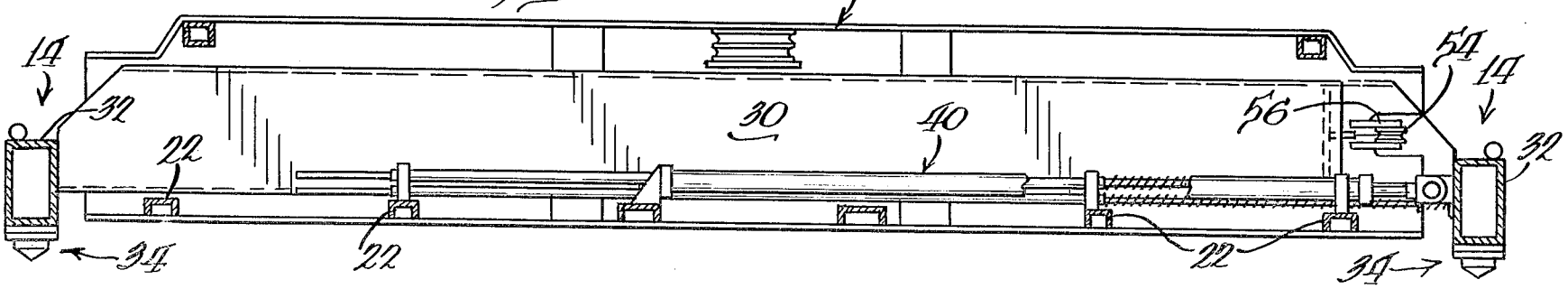
FIG. 2 is a side elevation view of the spreader shown in FIG. 1.

FIGS. 1 and 2 of the drawings disclose a spreader assembly generally designated by reference numeral 10 which is preferably of the type that can be used with a self-propelled vehicle of the type disclosed in United States Ser. No. 844,655, filed Oct. 25, 1977 and assigned to the assignee of the present invention. Spreader 10 includes a base section 12 and first and second extensible and retractable sections or members 14 extending from opposite ends of section 12. Base section 12 consists of first and second transversely spaced parallel beams 20 which are interconnected by a plurality of cross members 22 to define a substantially rectangular frame. In the preferred embodiment, beam 20 is in the form of an I-beam having a central vertical web portion 24 and a pair of upper and lower horizontal legs 26.

Each extensible section 14 is identical in cross section and only one will be described in detail. Extensible section or member 14 includes first and second transversely spaced parallel legs 30 which are interconnected at their outer ends by a transverse member 32 that may be secured thereto by welding. Legs 30 extend parallel to each other and are spaced from each other by a dimension which is equal to the spacing between the webs 24 of the respective beams 20. Legs 30 may be hollow rectangular beams or any other configuration having sufficient strength to support the weight of the container that is to be lifted.

Transverse beams 32 may also be hollow rectangular members each having a latching mechanism 34 at each end thereof. Latching mechanisms 34 are moved between the latched and unlatched position through fluid ram means 36 which will be described in more detail later.

Extensible members 14 are moved relative to base section 12 through independent drive means 40. In the illustrated embodiment, each drive means is in the form of a cylinder and piston rod assembly with a cylinder 42 supported on cross members 22 and secured thereto by suitable brackets 44. Piston rod 46 of fluid ram 40 is connected to cross member 32 through a suitable bracket 48.

Hydraulic fluid is supplied to opposite ends of fluid rams 40 through a suitable hydraulic circuit and electric control circuit therefor which is disclosed and claimed in copending application Ser. No. 947,548 filed Oct. 2, 1978, which is incorporated herein by reference. The hydraulic control circuit simultaneously supplies hydraulic fluid to the same end of both cylinders at an equal pressure so that the two sections 14 are extended simultaneously at approximately the same rate.

Spreader 10 also incorporates synchronizing means between the base section and each of the extensible members to produce equal increments of movement of both of the extensible members in response to actuation of fluid rams 40. The synchronizing means consists of first and second cables 50 of equal length having opposite ends respectively secured to the respective extensible members 14 and an intermediate portion guided on a pulley 54 that is supported by a bracket 56 on an end of an I-beam 20.

The manner in which the synchronizing mechanism operates is disclosed in United States Ser. No. 947,550 which is incorporated herein by reference.

The spreader so far described in capable of being extended and accurately positioned in a lengthwise direction to accommodate containers of varying length. However, as indicated above, difficulties are still encountered in being capable of utilizing the same spreader for lifting containers having ISO Standards and also containers having the Sealand Standards. Furthermore, if the castings of any containers are distorted or have become damaged, it may be difficult for the operator to insert the latching mechanisms into the apertures for the respective containers.

According to the present invention, the latching mechanisms on the spreader are designed so as to be universally movable to be insertable into apertures in castings on the corners of the containers while still being supported in a fixed position with respect to the spreader frame to absorb the loads and shock forces resulting from lifting the container and transporting it from one site to another.

Figure 5:
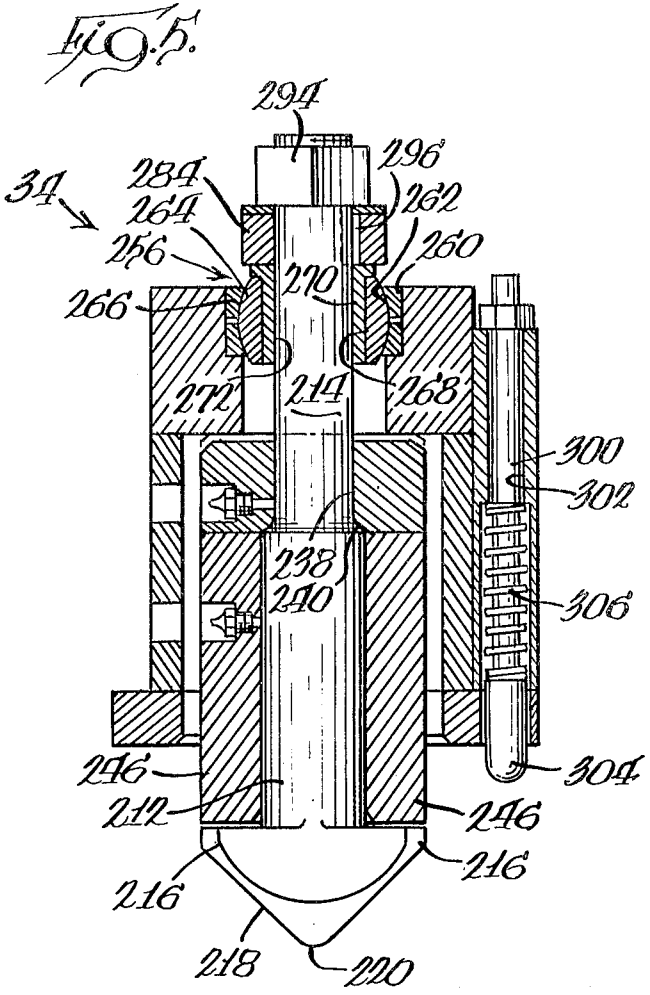
FIG. 5 is a sectional view as viewed generally along lines 5—5 of FIG. 3.
Figure 4:
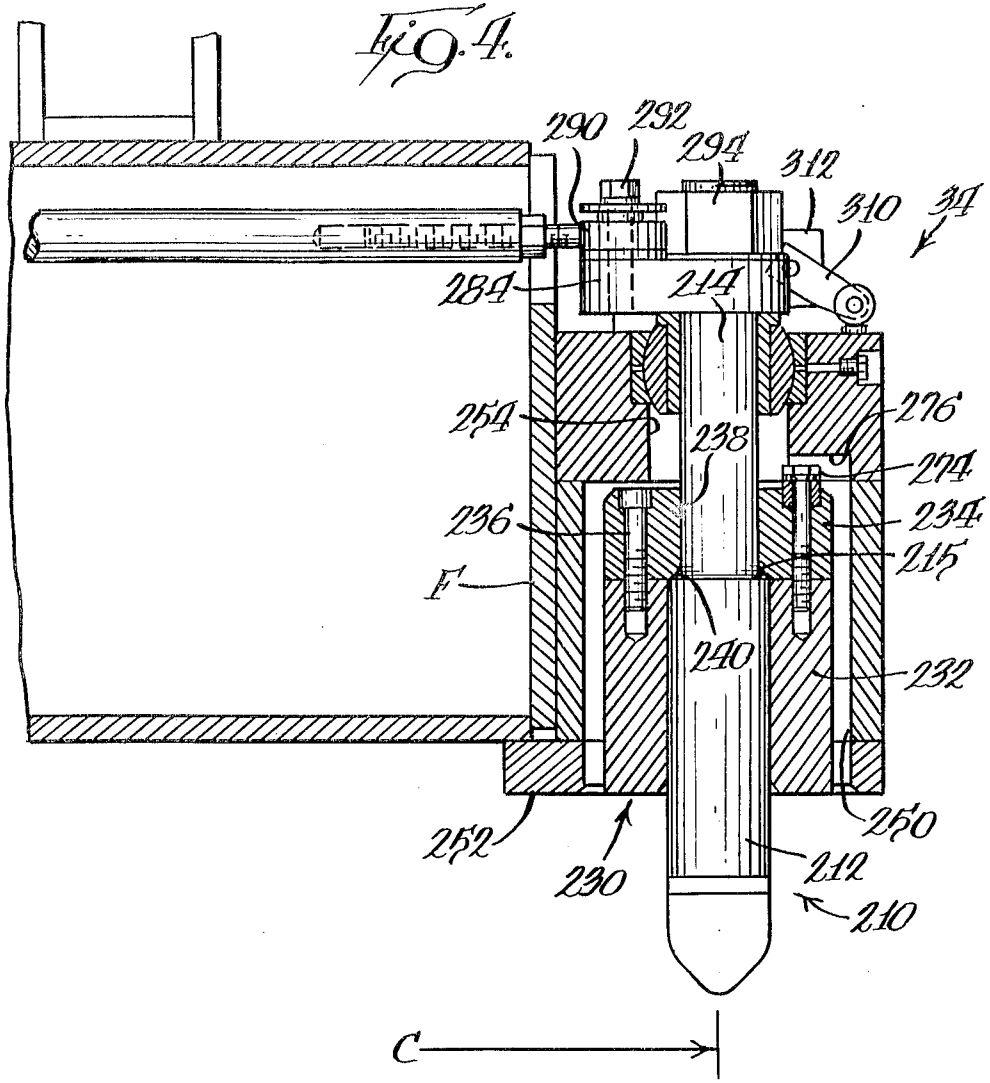
FIG. 4 is an enlarged fragmentary sectional view, as viewed along line 4—4 of FIG. 3.

The latching mechanism of the present invention is illustrated in detail in FIGS. 4 and 5 and includes an elongated circular shank 210 which has an enlarged portion 212 adjacent the lower end thereof and an intermediate reduced portion 214 with a shoulder 215 defined between the two portions. The lower end of the shank has first and second lugs 216 extending radially outwardly and the lower ends of the lugs and shank are tapered so that the lower end of the shank terminates substantially in a point 220. The upper surfaces of the lugs 216 extend perpendicular to the axis of shank 210 and define engaging surfaces for engaging the casting on the corner of a container.

A locator assembly 230 surrounds and is supported by an intermediate portion of shank 210. Locator assembly 230 includes a lower member 232 surrounding the enlarged portion of shank 210 and an upper portion 234 surrounding the reduced portion 214 of shank 210. Upper and lower portions 234 and 232 are interconnected by a plurality of screws 236 and the opening 238 in upper member 234 is flared outwardly at 240 on the lower end thereof to define a shoulder 240 which engages shoulder 215 on shank 210.

The lower end of lower portion 232 of locator assembly 230 has a pair of projections (FIG. 5) 246 and the projections 246 have a width (not shown) that is substantially equal to the diameter of enlarged portion 212. Projections 246 cooperate with shank 212 to define a locating member which has a size and shape that is substantially equal to the size of the smallest rectangular aperture in a casting complying with the ISO Standards.

Locator assembly 230 and shank 210 are supported on frame F through mounting means which will now be described. Frame F, particularly beam 32, has an enlarged circular opening 250 which is larger than the diameter of locator assembly 230 and which extends from a lower surface 252. Opening 250 has a reduced portion 254 at the upper end thereof and mounting means 256 is supported in the reduced portion 254 of the opening. Mounting means 256 consists of a thrust bearing having an outer race 260 which is fixed to the upper portion of frame F and defines a spherical inner surface 262. The thrust bearing also includes an inner race 264 that has a spherical surface 266 engaging surface 262. Inner race 264 also has a circular opening therein and circular opening 268 receives a collar 270 with the collar having an opening 272 that is substantially equal to the diameter of reduced portion 214 of shank 210. Thus, the inner and outer races 260 and 264 of the thrust bearing will allow the shank to universally move about a fixed point located in the center of the bearing races so that the lower tip 220 can move in all directions as will be described later. This movement of the tip 220 circumscribes a circle having a diameter of approximately 25.4 mm and is capable of being positioned at all points within the circle.

The circular opening 272 which receives reduced portion 214 of shank 210 will accommodate limited vertical movement of the shank and the locator assembly as a unit. This vertical movement is limited by having the upper surface of locator assembly 230 engage the shoulder defined adjacent reduced portion 254 of opening 250. Thus, any shock loads that are produced on the lower end of the shank during manipulation of the spreader frame into alignment with the container will be absorbed directly into the frame through the massive locator assembly and the cooperating shoulders 215 and 240 between the locator assembly and the shank.

The frame and locator member also cooperate with each other to prevent rotation of the locator member while accommodating rotation of the shank in the locator member. In the illustrated embodiment, one of the screws 236 extends above the upper surface of upper member 234 to define a projection 274 that extends into a recess 276 on the frame. The recess 276 has a width that is substantially equal to the size of projection 274 to limit rotation of locator assembly 230 to a small amount on frame F.

According to another aspect of the invention, the respective latching mechanisms 34 (FIG. 2) on each end of the spreader have a predetermined dimension between them to produce a predetermined center to center dimension for the respective adjacent pairs of shanks 210 (FIG. 4). As indicated above, the conventional ISO Standard has rectangular apertures in castings which are rounded off at opposite ends and into which the tip 220 of shank 210 must project in order to lift the containers. These rectangular apertures have a center to center spacing on each end of the container which is 2245 mm. The Sealand casting also has rectangular apertures, but these apertures have a rounded enlarged portion at the center thereof and have a center to center spacing of 2270 mm.

According to the present invention, the center to center spacing C (FIG. 1) for the axes or centers of the two shanks on one end of the container is 2268 mm or in other words is greater than the center to center spacing of one standard type of container and less than the center to center spacing for the second type of standard container. By arranging the centers of the respective shanks intermediate the two standard dimensions, the lower end 220 of shank 210 can move in either direction to readily be aligned with the openings for the two standard types of containers and also has additional movement capability for slightly warped or damaged containers.

Figure 3:
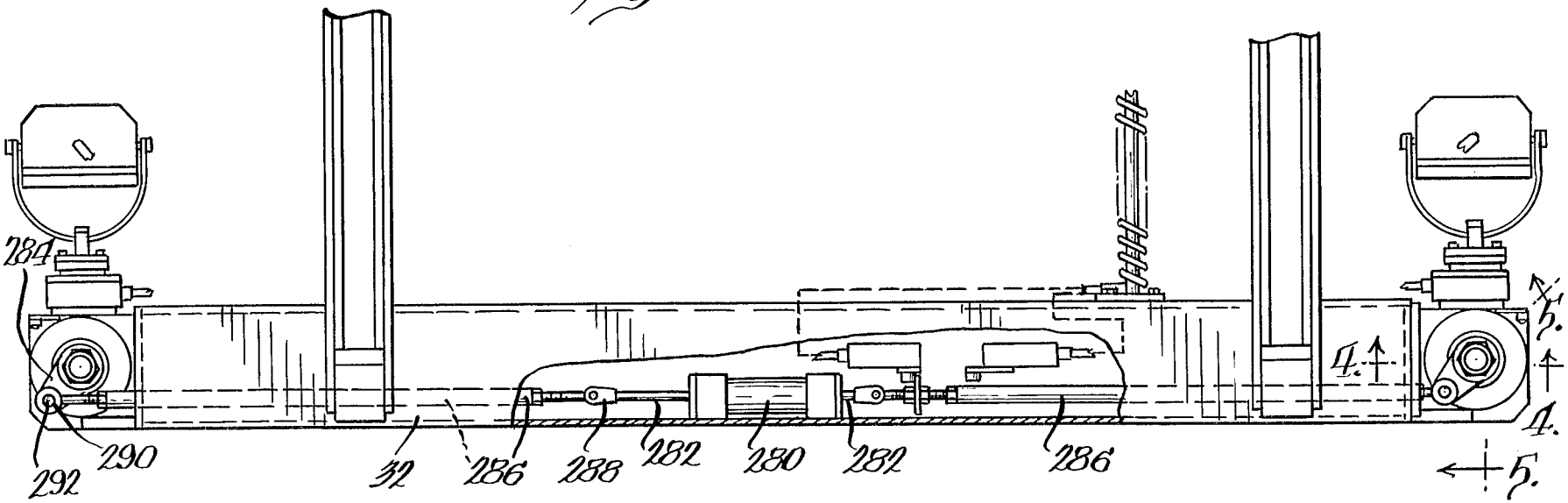
FIG. 3 is an enlarged fragmentary plan view of one end of the spreader illustrated in FIG. 1.

After the respective lower ends 220 of the shanks 210 and locator members 246 are properly positioned within the apertures in the top of a container, the respective shanks must be rotated approximately 90 degrees to define a locking position for the latching mechanism so that the container can then be lifted. The rotating means for producing such movement is most clearly illustrated in FIG. 3 and includes a single cylinder 280 which is supported on the center of transverse beam 32 and has a single piston (not shown) supported therein.

The single piston has two piston rods 282 extending from opposite sides thereof and each rod is connected to the free end of an arm 284 supported on the upper end of shank 210. The connection between arm 284 and piston rod 282 includes an adjustable connecting rod 286 which has one end connected through a clevis 288 to the free end of piston rod 282 and the opposite end connected to arm 284 through an eyelet bracket 290 and a bolt 292. As illustrated in FIG. 5, the inner end of arm 284 is retained on the upper end of shank 210 through a nut 294 and relative rotation is prevented through a rectangular key 296 received in slots in the arm and in the shank.

Utilizing a single cylinder equally from two latching mechanisms and two piston rods reduces the span or distance that must be traversed by the connecting rod which reduces the amount of distortion that might be encountered by the connecting rod during normal operation of the latching mechanisms.

As is conventional in spreader frames of this type, each latching mechanism also has indicator means for indicating when the lower end of shank 210 is in proper position with respect to the aperture on the container. This indicator means is illustrated as indicating a plunger 300 that is slidably supported in an opening 302 in frame F with the lower end 304 of plunger 300 normally biased by spring 306 to the position illustrated in FIG. 5. In this position, the lower end of the plunger extends below surface 252 of frame F. The upper end of plunger 300 cooperates with a switch actuator 310 of a switch 312. Thus, when the latching mechanism is inserted into the rectangular aperture on the container, the plunger is forced upwardly by engaging the top surface of the container to actuate switch 312 and indicate that the latching mechanism is in proper position for being rotated 90 degrees to a locking position.

As can be appreciated from the above description, the present invention provides a unique system which is capable of lifting containers having two different types of standard fittings with apertures that are on different center to center spacings. By having the latching shanks universally movable, the size of the latching mechanism can be made substantially larger because the shank and locator assembly can conform to the size of the smaller aperture for the two standard castings. Also, the thrust bearings which can be utilized may be conventional commercial units since most of the shock load in the axial direction will be absorbed through the massive locator assembly engaging the frame directly.

I claim:

1. A top lift cargo container lifting frame with four corners each having a latching mechanism attached thereto, each latching mechanism including an elongated shank having locking lugs at one end thereof, a locator member surrounding said shank adjacent said locking lugs, and mounting means on said frame for said shank, said mounting means accommodating (1) universal movement of said shank about a fixed point on said frame and (2) axial movement of said shank with respect to said fixed point on said frame, said locator member cooperating with said frame to limit axial movement of said shank on said frame.

2. A lifting frame as defined in claim 1, further including cooperating means between said frame and said locator member to prevent rotational movement of said locator member with respect to the axis of said shaft while accommodating rotational movement of said shank on said frame.

3. A lifting frame as defined in claim 2, in which said shank has an enlarged portion adjacent said locking lugs and reduced portion adjacent an opposite end to define a shoulder on an intermediate portion of said shank and said locator member surrounds said enlarged portion and a part of said reduced portion and engages said shoulder to prevent axial movement of said locator member on said shank in an axial direction away from said frame.

4. A twist-lock for a lifting frame comprising an elongated shank having a base portion at one end thereof with locking lugs integral with said base portion, said shank having an enlarged portion adjacent said base portion and a reduced portion adjacent said enlarged portion, mounting means on said frame for supporting said shank for universal movement about a fixed point on said frame, said mounting means accommodating axial movement of said shank on said frame, and locator means surrounding said shank and having a locator portion adjacent said base portion, said locator means being movable axially with said shank and cooperating with said frame to limit axial movement of said shank on said frame.

5. A twist-lock as defined in claim 4, further including cooperating means between said frame and said locator means preventing rotational movement of said locator means relative to the axis of said shank.

6. A twist-lock as defined in claim 5, in which said frame has a recess adjacent said shank and said locator means has a projection extending into said recess to define said cooperating means.

7. A twist-lock as defined in claim 6, in which said mounting means includes a first member on said frame defining a spherical opening with a second member on said shank having a spherical surface engaging said opening and accommodating universal movement of said shank on said frame, said second member having a circular opening receiving said reduced portion of said shank to accommodate axial movement of said shank on said frame.

8. A latching mechanism for a lifting frame comprising an elongated shank having a base portion at one end thereof with integral locking lugs on said base portion, a locator member surrounding said shank adjacent said base portion and mounting means for mounting said shank on said frame, the improvement of said mounting means including a spherical bearing having an outer race fixed on said frame and an inner race with said inner race supporting said shank adjacent an opposite end thereof, said inner and outer races having cooperating spherical surfaces allowing universal movement of said base portion with respect to a fixed point on said frame.

9. A latching mechanism as defined in claim 8, further including a sleeve between said shank and said inner race, said sleeve accommodating axial movement of said shank with respect to inner race, said locator member moving with said shank and adapted to engage said frame to limit said axial movement and transfer shock loads received by said base portion directly to said frame.

10. A rectangular spreader frame for lifting elongated rectangular containers having latching apertures adjacent each corner thereof, with a first type of container having a first transverse center to center spacing between each adjacent pair of apertures and a second type of container having a second transverse center to center spacing between each adjacent pair of apertures which is greater than said first spacing, said spreader frame having four latching mechanisms adjacent the corners thereof, each latching mechanism including an elongated shank rotatable about a fixed axis between latched and unlatched positions with a locator member surrounding said shank, mounting means on said frame for each shank accommodating universal movement of said shank about a fixed point on said frame, said mounting means being positioned on said frame so that the transverse spacing of the fixed points of adjacent pairs of shanks is greater than said first transverse center to center spacing and is less than said second transverse center to center spacing so that free latching ends of said shanks can be received into the apertures of both types of containers.

11. A rectangular spreader frame as defined in claim 10, in which said transverse spacing of the fixed points is equal to said first transverse spacing plus one-half the difference between said first and second transverse spacings.

12. A rectangular spreader frame as defined in claim 11, in which said mounting means accommodates axial movement of said shank with respect to said fixed point and said locator members cooperates with said frame to limit said axial movement.

* * * * *